US005711318A

United States Patent [19]

Saitoh et al.

[11] Patent Number: 5,711,318

[45] Date of Patent: Jan. 27, 1998

[54] TRIMMING CONTROL DEVICE FOR CIGARETTE MANUFACTURING MACHINE

[75] Inventors: Masayoshi Saitoh; Shigemitsu Inomata; Shigenobu Kushihashi, all of Tokyo, Japan

[73] Assignee: Japan Tobacco, Inc., Tokyo, Japan

[21] Appl. No.: 601,772

[22] Filed: Feb. 15, 1996

[30] Foreign Application Priority Data

Feb. 15, 1995 [JP] Japan ..... 7-027142

[51] Int. Cl.[6] ..... A24C 5/18

[52] U.S. Cl. ..... 131/84.1; 131/84.2; 131/84.3; 131/84.4; 131/906; 74/395

[58] Field of Search ..... 131/84.1, 84.4, 131/906; 74/395; 474/900; 464/161

[56] References Cited

U.S. PATENT DOCUMENTS

| | | | |
|---|---|---|---|
| 2,260,402 | 10/1941 | Potdevin | 74/395 |
| 2,449,807 | 9/1948 | Frei | 74/395 X |
| 3,604,429 | 9/1971 | De Witt | 131/906 X |
| 3,604,430 | 9/1971 | Norwich et al. | 131/906 X |
| 3,742,795 | 7/1973 | Lipcon et al. | 131/906 X |

FOREIGN PATENT DOCUMENTS

| | | |
|---|---|---|
| 0617901 | 5/1994 | European Pat. Off. . |
| 0613623 | 7/1994 | European Pat. Off. . |

*Primary Examiner*—V. Millin

[57] ABSTRACT

A trimming control device for a cigarette manufacturing machine is provided with a pair of rotatable trimming disks having pockets on their peripheral edges for trimming a shredded tobacco layer on a tobacco band, a detecting device for detecting a filling density of the shredded tobacco in a tobacco rod, and a control board to which output from the detecting device is supplied. The control board makes a filling density distribution in the cigarette rod by sampling the output of the detecting device, extracts a peak zone including a peak from the filling density distribution, and determines a target cutting position of a tobacco rod at the central position of the peak zone.

8 Claims, 9 Drawing Sheets

TRIMMING CONTROL DEVICE FOR CIGARETTE MANUFACTURING MACHINE

BACKGROUND OF THE INVENTION

1. Field of the Invention

The present invention relates to a device for controlling of a thickness of a shredded tobacco layer by trimming the layer fed toward a wrapping device of a cigarette manufacturing machine.

2. Description of the Related Art

A cigarette manufacturing machine is provided with a wrapping device for continuously forming a tobacco rod and sending out the formed tobacco rod, and a cutting device for cutting the tobacco rod sent out of this wrapping device into individual cigarette rods. In each of the cigarette rods, a filling density of the shredded tobacco in the cut end of cigarette rod is higher than that of the shredded tobacco in the other portion. Accordingly, loss of the shredded tobacco from the cut end of cigarette rod when the cutting of tobacco rod or during transportation of the cigarette rod can be prevented.

In order to obtain the above-mentioned cigarette rods, the filling density of shredded tobacco in cutting portions to be cut is increased in advance rather than that of the shredded tobacco in the other portions. Thus, a trimming device is incorporated in the cigarette manufacturing machine, and this trimming device trims the shredded tobacco layer fed toward the wrapping device and increases the thickness of the shredded tobacco layer with a predetermined interval. Specifically, the trimming device is provided with a rotatable trimming disk. This trimming disk has a plurality of pockets formed on its peripheral edge, and these pockets are arranged at equal intervals in the circumferential direction of the trimming disk. When the trimming disk is rotated, the peripheral edge of the trimming disk eliminates excess shredded tobacco from the shredded tobacco layer moving toward the wrapping device so that increase portions are formed in the trimmed tobacco layer at predetermined intervals corresponding to the rotation cycle of the pockets, the thickness of the increase portions being increased rather than that in the other portions.

After trimming, the shredded tobacco layer is wrapped with paper with the help of a garniture tape in the wrapping device, whereby the tobacco rod is continuously formed. In the tobacco rod formed in this manner, the cutting portions to be cut are formed at predetermined intervals, and the filling density of the shredded tobacco in these cutting portions is increased rather than that in the other portions. Therefore, if the tobacco rod is cut at the center of the cutting portions in the cutting device, the above-mentioned cigarette rods can be obtained. Thus, the cutting of the tobacco rod in the cutting device should be carried out with the timing that a cutter of the cutting device passes through the center of the cutting portion to be cut, that is, the timing corresponding to a rod speed of the tobacco rod.

However, when the tobacco rod is formed, if slippage occurs between the tobacco rod and the garniture tape, the timing to cut the tobacco rod does not synchronize with timing that the cutter of the cutting device passes through the center of the portion and the cutting of tobacco rod can not be executed exactly at the center of the cutting portion, that is, the target cutting position.

As the above-mentioned slippage of the tobacco rod is increased when the rod speed is raised, the tobacco rod is cut largely away from the target cutting position. Also, the recent research result has shown that, even if the rod speed of the tobacco rod is constant, dislocation between the actual cutting position and the target cutting position in the tobacco rod is changed every moment.

Thus, it is desirable that the cutting dislocation from the target cutting position should be monitored all the time so that, if there is an unacceptable cutting dislocation, the actual cutting position of the tobacco rod should be immediately made in accord with the target cutting position.

In the meantime, in order to detect the dislocation between the target cutting position and the actual cutting position of the tobacco rod, it is necessary that the target cutting position of the tobacco rod should be set accurately. For this end, after distribution of the filling density of the shredded tobacco in the tobacco rod is obtained, the peak in this filling density distribution may be set as the target cutting position. However, in the case of the filling density distribution having a continuous peak over a certain zone, if the target cutting position is set at the end of the peak zone, the filling density of the shredded tobacco may run short at the cut end of the cigarette rod. Also, in the case of the filling density distribution having a sharp drop from the peak, the target cutting position can not be set at the peak.

SUMMARY OF THE INVENTION

The object of the present invention is to provide a trimming control device for a cigarette manufacturing machine, for properly setting a target cutting position of a continuous tobacco rod and for automatically correcting dislocation between the target cutting position and the actual cutting position.

The above object is achieved by a trimming control device according to the present invention, and the trimming control device comprises trimming means for adjusting a thickness of a shredded tobacco layer, the trimming means including a rotatable trimming disk, the trimming disk having pockets formed on a peripheral edge thereof, the shredded tobacco layer being trimmed by rotation of the trimming disk when the shredded tobacco layer is continuously fed toward a wrapping device for forming a tobacco rod in a cigarette manufacturing machine so that after trimming, increase portions whose thickness are increased by the pockets of the trimming disk are cyclically formed in the shredded tobacco layer, detecting means for detecting a filling density of the shredded tobacco in the tobacco rod and continuously putting out the detected filling density in a process that the tobacco rod formed in the wrapping device is continuously fed from the wrapping device to a cutting device of the cigarette manufacturing machine, data processing means for obtaining a filling density distribution of the shredded tobacco in the cigarette rod based on the filling density output from the detecting means, the cigarette rod being formed by cutting the increase portion of the tobacco rod in the cutting device, determining means for determining a target cutting position of the tobacco rod at a center position of the increase portion based on the filling density distribution, and adjusting means for detecting a deviation between the target cutting position and the cut end of the cigarette rod and for adjusting a rotation phase of the pockets of the trimming disk in the direction to eliminate the deviation.

According to the above-mentioned trimming control device, first, the filling density distribution of the shredded tobacco in the cigarette rod obtained by cutting the tobacco rod is made. From the filling density distribution thus obtained, a zone showing the increase portion of the shredded tobacco layer is extracted, and the central position of this zone is determined as a target cutting position of the tobacco rod. After that, a deviation between the determined target cutting position and the cut end of the cigarette rod is detected, and based on this deviation, the rotation phase of the pocket of the trimming disk is adjusted, that is, the rotation phase is advanced or delayed. By this, the cut end of the cigarette rod is positioned at the target cutting position.

When the cut end of the cigarette rod is made to correspond with the target cutting position in this way, the filling density of the shredded tobacco in the neighborhood of the cut end is sufficiently high, and the shredded tobacco will not drop form the cut end but the quality of the cigarette rod can be improved.

The data processing means may include sampling means which equally divides a cigarette rod to be cut off from the tobacco rod to a predetermined number of sections and samples the filling density of the shredded tobacco in each section. The data processing means makes a filling density distribution from the filling density of each section. In this case, according to the filling density distribution made in this manner, the relation between the position of the cigarette rod obtained by the increase portion of the shredded tobacco layer and the cut end of the cigarette rod can be easily grasped.

The data processing means may further include recording means for collecting the filling density of each section in the predetermined number of the cigarette rod. The data processing means makes a filling density distribution from average filling density of each section. In this case, the filling density distribution made in this manner shows an actual filling density distribution in the cigarette rods with more accuracy.

The data processing means may further include display means for displaying the filling density distribution obtained. In this case, the filling density distribution of the shredded tobacco in the manufactured cigarette rod can be visually grasped.

The display means preferably displays the actual cutting position of the tobacco rod in addition to the filling density distribution. In this case, the deviation between the target cutting position and the cut end of the cigarette rod or the actual cutting position can be visually grasped.

The above-mentioned determining means preferably extracts a peak zone including a peak of density from the prepared density distribution and determines a target cutting position at the central position of the peak zone in view of the width direction of this peak zone. In this case, at both sides of the target cutting position, that is, in the neighborhood of the cut end of the cigarette rod, the filling density of the shredded tobacco can be surely increased.

The determining means preferably extracts a range as the peak zone above the density value which is lowered from the peak by a predetermined proportion.

The above-mentioned adjusting means includes a gear train for transmitting a torque to the trimming disk, and the gear train has a pair of helical gears engaged with each other and moving means for moving one of the helical gears in its axial direction. In this case, by changing the engaging position of the pair of helical gears, the rotation phase of the pockets of the trimming disk can be easily adjusted.

Specifically, the moving means includes a slider member integrally moved with one of the helical gears in relation to the axial direction of the helical gear, the slider rotatably supporting the helical gear, a feed screw for moving the slider member in the axial direction thereof and a step motor for rotating the feed screw forward and backward.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION OF THE PREFERRED EMBODIMENT

Figure 1:
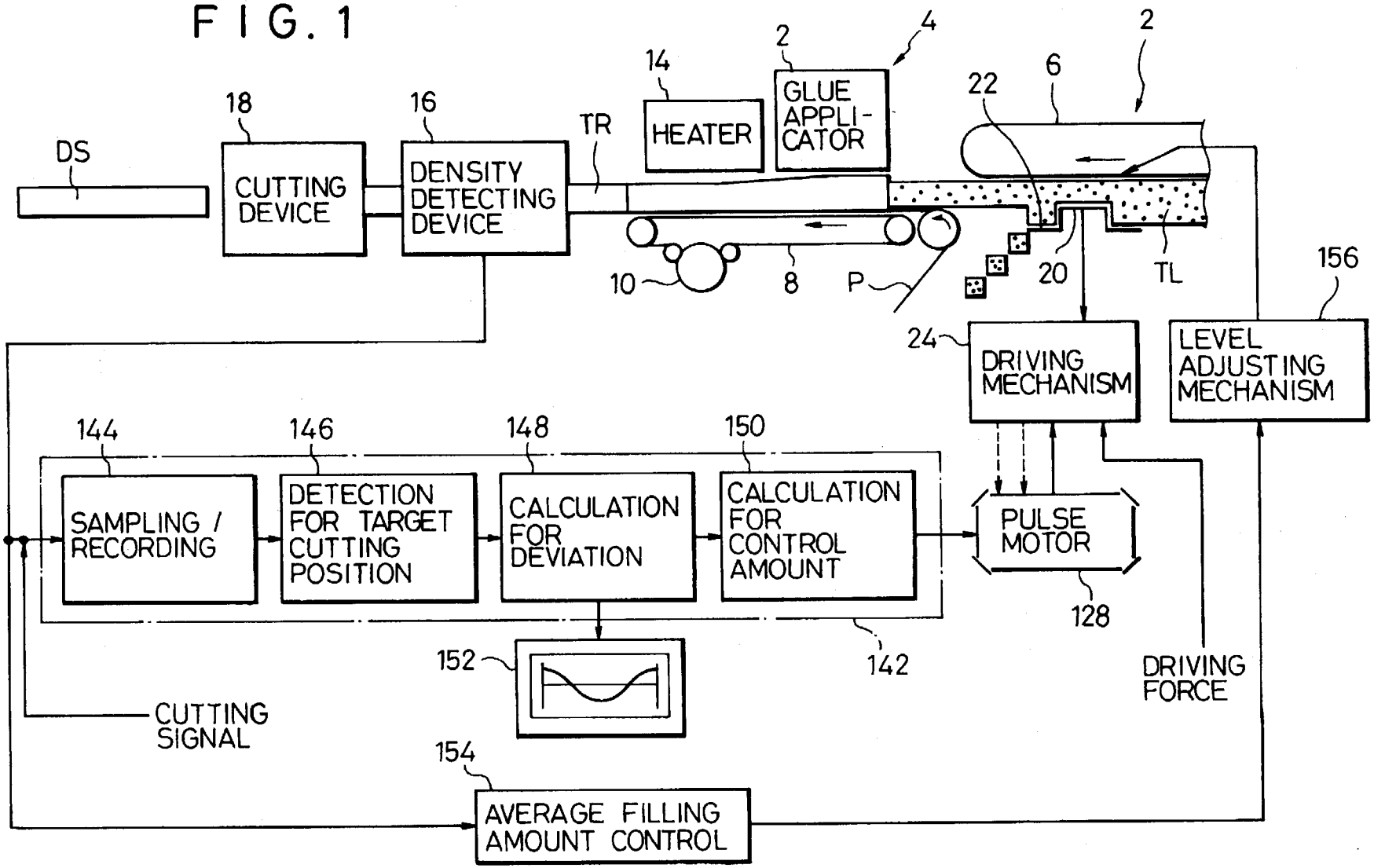
FIG. 1 is a schematic view showing an entire cigarette manufacturing machine including a trimming control device of a preferred embodiment.

Referring to FIG. 1, a cigarette manufacturing machine is provided with a feeding section 2 for shredded tobacco and a wrapping device 4. The feeding section 2 has an endless suction band, that is, a tobacco band 6. The tobacco band 6 sucks up the shredded tobacco from a chimney onto the lower surface thereof in a layered state so that a shredded tobacco layer TL is formed on the lower surface of the tobacco band 6. The shredded tobacco layer TL is continuously fed toward the wrapping device 4 as the tobacco band travels.

The wrapping device 4 is provided with an endless garniture tape 8, and paper P sent out from a roll (not shown) is led onto the garniture tape 8. The garniture tape 8 is wound around a driving drum 10 which is rotated at a predetermined peripheral speed and travels in one direction with rotation of the driving drum 10. When the garniture tape 8 is driven, the paper P also runs in the same direction with the garniture tape 8.

At the inlet end of the wrapping device 4, the tobacco band 6 feeds the shredded tobacco layer TL onto the paper P. The shredded tobacco layer TL on the paper P passes through the wrapping device 4 when the paper P as the garniture tape 8 is running. In this passing-through process, the shredded tobacco layer TL is wrapped with the paper P as known, whereby a tobacco rod TR is continuously formed. The formed tobacco rod TR is continuously sent out of the outlet end of the wrapping device 4. The wrapping device 4 is provided with a glue applicator 12 for applying a glue to one side edge of the paper P and a heater 14 for drying the glued part of the formed tobacco rod TR.

The tobacco rod TR sent out of the wrapping device 4 passes through a density detecting device 16 and then, led to a cutting device 18. The cutting device 18 cuts the tobacco rod TR into a certain length, that is, into a double cigarette DS with the length of two cigarettes. Here, the cutting timing for the tobacco rod TR with the cutting device 18 is determined according to the running speed of the above-mentioned garniture tape 8, that is, the rotation speed of the driving drum 10 which determines the manufacturing speed of the tobacco rod TR.

In the double cigarette DS obtained by the cutting device 18, the filling density of the shredded tobacco is increased in its cut ends rather than that of in the other portion. This is obtained by trimming the shredded tobacco layer TL on the tobacco band 6.

For this trimming work, a pair of trimming disks 20 are provided at the outlet end of the tobacco band 6, and these pair of trimming disks 20 are arranged under the tobacco band 6. In more detail, the pair of trimming disks 20 are arranged so that their peripheral edges are rotated in contact with each other at the central position in view of the width direction of the tobacco band 6. On the peripheral edge of each of the trimming disks 20, a plurality of pockets 22 are formed, and these pockets 22 are arranged at equal intervals in the circumferential direction of the corresponding trimming disk 20.

The pair of trimming disks 20 are connected to a driving mechanism 24, and the driving mechanism 24 has a function to adjust the rotation phase of the trimming disks 20, which will be mentioned later. The driving mechanism 24 rotates the pair of trimming disks 20 in the direction opposite to each other. As a result, each of the pockets 22 of one of the trimming disks 20 and the corresponding pocket 22 of the other trimming disk 20 cyclically accord or match with each other immediately under the tobacco band 6, and the two accorded pockets 22 move in the running direction of the tobacco band 6 at the same speed as the running speed of the tobacco band 6. That is, the peripheral speed of the trimming disks 20 accords with the running speed of the tobacco band 6.

When the shredded tobacco layer TL passes through the pair of trimming disks 20, these trimming disks 20 eliminate excess shredded tobacco from the shredded tobacco layer TL with their rotation to trim the shredded tobacco layer TL to a predetermined thickness. That is, the thickness of the shredded tobacco layer TL is set at an interval between the trimming disks 20 and the tobacco band 6. However, as the pockets 22 are formed on the peripheral edges of the trimming disks 20, increase portions whose thickness is increased rather than that of the other portions by the pockets 22 are cyclically formed in the trimmed shredded tobacco layer TL.

Here, in the shredded tobacco layer TL, the interval of the increase portions is set to an interval corresponding to the length of the double cigarette DS. The rotation phase of the pockets 22 in the trimming disks 20 synchronizes with the above-mentioned cutting timing of the tobacco rod TR.

When this point is explained in more detail, the trimmed tobacco layer TL is fed to the wrapping device 4 and the tobacco rod TR is formed in the wrapping device 4, and then, in the formed tobacco rod TR, portions with higher shredded-tobacco filling density corresponding to the increase portions of the shredded tobacco layer TL, that is, cutting portions to be cut are cyclically formed, and the tobacco rod TR is cut at the center of the cutting portions by the cutting device 18.

The driving mechanism 24 not only rotates the pair of trimming disks 20 but also has a function to adjust the rotation phase of the pockets 22 of these trimming disks 20. The specific structure of the driving mechanism 24 is shown in FIGS. 2 and 3.

Figure 2:
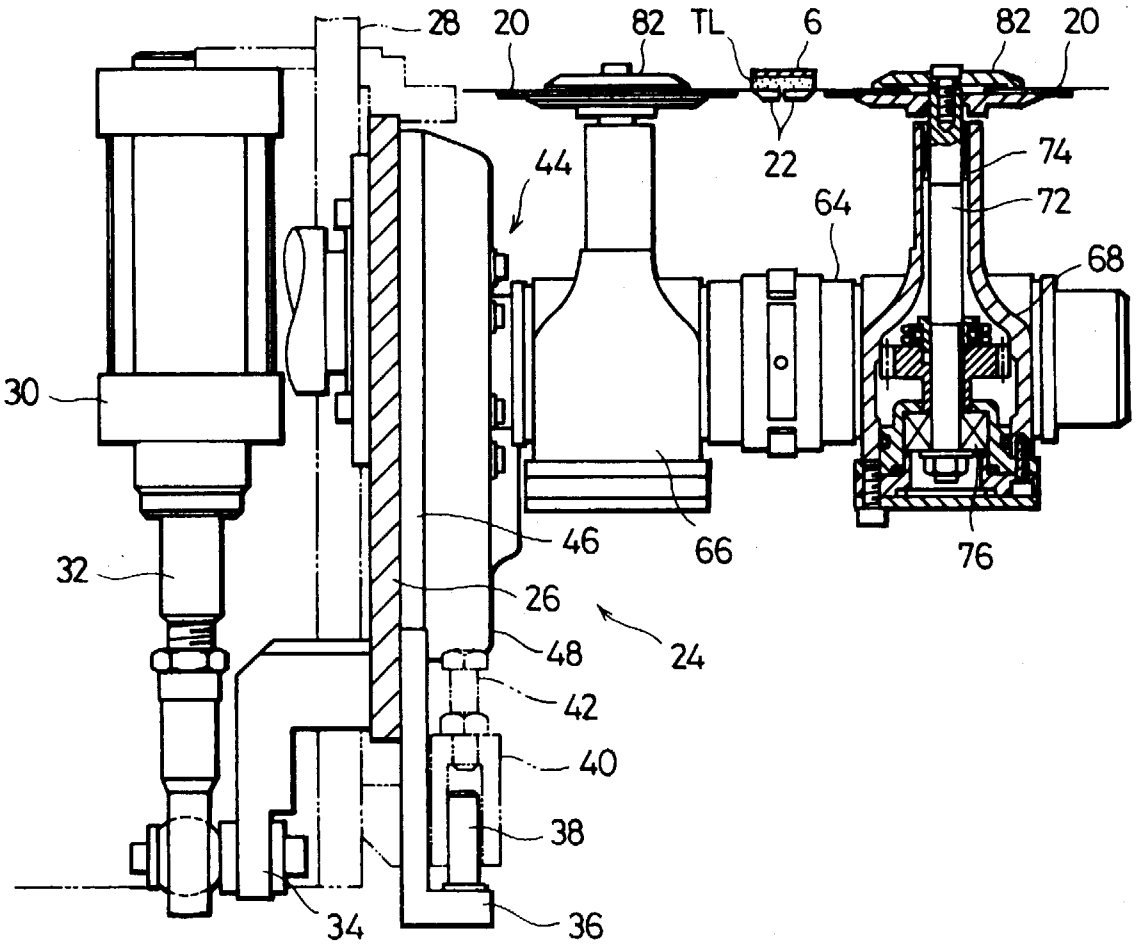
FIG. 2 is a partially broken view showing a driving mechanism of a pair of trimming disks.
Figure 3:
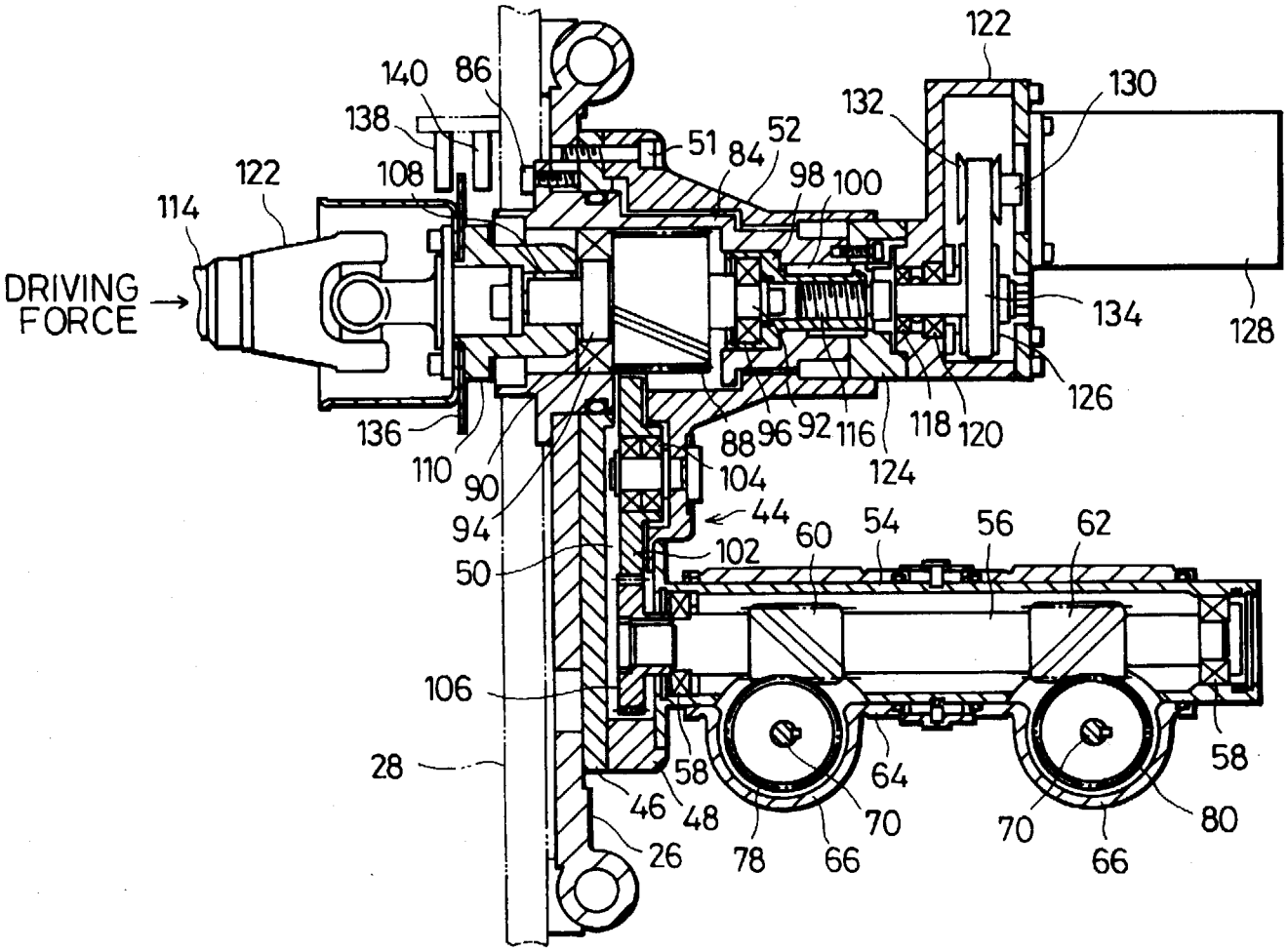
FIG. 3 is a cross sectional view of the driving mechanism in FIG. 2.

Referring to FIG. 2, the driving mechanism 24 is provided with a mount plate 26. This mount plate 26 is arranged on the outer side of a frame 28 of the cigarette manufacturing machine, that is, on the front side of the cigarette manufacturing machine and is elevatably supported against the frame 28. The frame 28 is shown by a two dot chain line in FIGS. 2 and 3.

A vertical cylinder 30 made of an air cylinder is arranged in the inverted state in the frame 28. This vertical cylinder 30 has an outer cylinder part and a piston rod 32, and the outer cylinder part is supported by the frame 28. The piston rod 32 protrudes downward from the outer cylinder part, and the lower end of the piston rod 32 is connected to a bracket 34 through a ball joint. The bracket 34 extends from the mount plate 26. Thus, when the piston rod 32 of the vertical cylinder 30 is telescopically moved, the mount plate 26 is vertically moved against the frame 28 with this telescopic movement.

An extension plate 36 is mounted at the lower end of the mount plate 26, and this extension plate 36 is arranged opposite to the bracket 34. The extension plate 36 is in the shape of the letter L in FIG. 2, and a pin 38 protrudes upward from the horizontal lower end part of the extension plate 36. This pin 38 is inserted into a guide 40 from beneath, and the guide 40 is fixed to the frame 28. A stopper bolt 42 is screwed into the guide 40 from above, and the stopper bolt 42 can regulate raise of the pin 38.

As can be seen from FIG. 3, the mount plate 26 is provided with a gear casing 44. The gear casing 44 is provided with an end plate 46 stuck to the mount plate 26, and a casing shell 48. The casing shell 48 cooperates with the end plate 46 to define a gear chamber 50 extending along the end plate 46 in the gear casing 44. A hollow cylinder part 52 protrudes outward from one end of the casing shell 48, while an inner sleeve 54 protrudes outward from the other end of the casing shell 48. The cylinder part 52, the inner sleeve 54, the casing shell 48 and the end plate 46 are integrally assembled with connecting bolts 51 and connected to the mount plate 26 through the connecting bolts 51. In more detail, the cylinder part 52 and the inner sleeve 54 are connected to the casing shell 48 in flange connection at their one ends, and the cylinder part 52 and the inner sleeve 54 extends in parallel with each other.

A worm shaft 56 is arranged in the inner sleeve 54. The worm shaft 56 extends on the axis of the inner sleeve 54, and both its ends are rotatably supported by the inner sleeve 54 through a pair of bearings 58. The gear chamber 50 of the gear casing 44 communicates into the inner sleeve 54, and one end of the worm shaft 56 positioned on the gear casing 44 side protrudes into the gear chamber 50.

On the worm shaft 56, a pair of worms 60 and 62 are integrally formed. These worms 60 and 62 are arranged with a predetermined interval in the axial direction of the worm shaft 56, and helical directions of gear teeth of these worms 60 and 62 are opposite to each other.

On the outer side of the inner sleeve 54, an outer sleeve 64 is mounted. The outer sleeve 64 is in the shape of a pipe surrounding the inner sleeve 54, and a pair of shaft holders 66 are integrally formed at the portions corresponding to the worms 60 and 62. These shaft holders 66 are in the shape of a hollow cylinder expanding outward in the radial direction of the outer sleeve 64. In more detail, the shaft holders 66 extend upward and their outer ends are in the shape of a complete pipe. However, the lower ends of the shaft holders 66 are in the shape of an almost semi-cylinder and are made to communicate into the inner sleeve 54 through openings formed in the inner sleeve 54.

In the shaft holders 66, disk shafts 70 extend vertically, respectively, and the upper ends and the lower ends of these disk shafts 70 are rotatably supported by the shaft holders 66 through bearings 74 and 76. At intermediate parts of the disk shafts 70, worm wheels 78 and 80 are mounted, respectively, and these worm wheels 78 and 80 are engaged with the corresponding worms 60 and 62. Each of the disk shafts 70 protrudes from the upper end of the shaft holder 66, and at the protruding end, each of the trimming disks 20 is mounted through a clamper 82.

In the cylinder part 52 of the gear casing 44, a stepped sleeve 84 is arranged coaxially. The stepped sleeve 84 has a large diameter end positioned on the mount plate 26 side, and this large diameter end passes the end plate 46 of the gear casing 44 and the mount plate 26 and is fixed to the mount plate 26 through a plurality of connecting screws 86. A helical gear 88 is arranged in the stepped sleeve 84, and has gear shafts 90 and 92. The gear shafts 90 and 92 extend from both end faces of the helical gear 88, respectively. The gear shaft 90 positioned on the mount plate 26 side is rotatably supported by the stepped sleeve 84 through a bearing 94. The other gear shaft 92 is rotatably supported by a slider 98 in the sleeve shape through a bearing 96. However, the gear shaft 92 is integrally connected to the slider 98 in relation to the axial direction thereof. The slider 98 is slidably engaged within the stepped sleeve 84 and connected to the stepped sleeve 84 through a key 100. Thus, the slider 98 can move within the stepped sleeve 84 in its axial direction, but rotation of the slider 98 around the axis thereof is prevented.

An intermediate gear 102 is arranged in the gear chamber 50 of the casing shell 48, and the intermediate gear 102 is rotatably supported by the casing shell 48 through a bearing 104. The intermediate gear 102 is engaged with the helical gear 88. Moreover, on one end of the worm shaft 56, that is, one end protruding into the gear chamber 50, a shaft gear 106 is mounted, and the shaft gear 106 is also engaged with the intermediate gear 102.

The gear shaft 90 of the helical gear 88 is inserted into a hollow driving shaft 110, and the driving shaft 110 and the gear shaft 90 are linked to each other through a key 108. The driving shaft 110 is connected to a power transmission system 114 through a universal joint 112. The power transmission system 114 is connected to a driving source which is not shown, and a driving force from this driving source is transmitted to the driving shaft 110 through the power transmission system 114 and the universal joint 112. When the driving shaft 110 receives the driving force and is rotated, this rotation is transmitted to the worm shaft 56 through the helical gear 88, the intermediate gear 102 and the shaft gear 106 and then to the pair of worm wheels 78 and 80 from the worms 60 and 62 of the worm shaft 56. As a result, the trimming disks 20 are rotated. Here, as the helical directions of the teeth of the worms 60 and 62 are opposed to each other, the pair of trimming disks 20 are rotated in the opposite direction to each other.

The driving source can give a driving force to the driving drum 10 of the garniture tape 8 and a cutter of the cutting device 18 through a separate power transmission system, and the peripheral speed of the pair of trimming disks 20 is set according to the peripheral speed of the driving drum 10. That is, as mentioned above, it is so set that the rotation phase of the pockets 22 of the trimming disks 20 synchronizes with the cutting timing in the cutting device 18.

A feed screw 116 is screwed into the slider 98 connected to the gear shaft 92 of the helical gear 88, and the feed screw 116 has a shaft part protruding from the slider 98. The shaft part of the feed screw 116 is rotatably supported by a pulley casing 122 through bearings 118 and 120. The pulley casing 122 is integrally combined through an intermediate ring 124, and the intermediate ring 124 is inserted into the cylinder part 52 of the casing shell 48. The intermediate ring 124 is linked to a small diameter end of the stepped sleeve 84 through a plurality of connecting screws.

The shaft part of the feed screw 116 protrudes into the pulley casing 122, and on the protruding end of the shaft part is mounted a toothed pulley 126. A pulse motor 128 is mounted on the outer face of the pulley casing 122, and an output shaft 130 of the pulse motor 128 also protrudes into the pulley casing 122. On the protruding end of the output shaft 130, a toothed pulley 132 is mounted, and an endless toothed belt 134 connects the toothed pulley 132 with the toothed pulley 126 of the feed screw 116.

Thus, when the pulse motor 128 is driven, rotation of the output shaft 130 thereof is transmitted to the feed screw 116 through the toothed pulley 132, the toothed belt 134 and the toothed pulley 126, and as a result, the feed screw 116 is rotated.

As the feed screw 116 is screwed into the slider 98, the rotation of the feed screw 116 displaces the helical gear 88 in its axial direction through the slider 98. In this case, the engagement position of the intermediate gear 102 against the helical gear 88 is changed in the axial direction of the helical gear 88. As a result, the rotation phase of the gear train from the intermediate gear 102 to the pair of worm wheels 78 and 80, that is, the rotation phase of the pockets 22 of the pair of trimming disks 20 is advanced or delayed against the helical gear 88.

A magnetic disk 136 is mounted on the driving shaft 110 linked integrally with the helical gear 88, and a pair of proximity sensors 138 and 140 are provided in the neighborhood of the magnetic disk 136. These proximity sensors 138 and 140 are arranged so that the peripheral edge of the magnetic disk 136 is located between the sensors 138 and 140. When the helical gear 88 is displaced in its axial direction, as mentioned above, the driving shaft 110 is also displaced in its axial direction with the magnetic disk 136. With this displacement, when one of the proximity sensors detects approach of the magnetic disk 136, the proximity sensor outputs a stop signal for the pulse motor 128. Thus, the displacement range of the helical gear 88 is determined by the stop signal from the pair of proximity sensors 138 and 140. In order to absorb displacement in the axial direction of the driving shaft 110, that is, the universal joint 122, an expansion joint is inserted into the power transmission path 114.

The pulse motor 128 for displacing the helical gear 88 in its axial direction within an allowable range is electrically connected to a control board 142 as shown in FIG. 1, and the control board 142 controls driving of the pulse motor 128 based on a detection signal from the above-mentioned density detecting device 16.

First, the density detecting device 16 is provided with a radiation type density sensor, and the density sensor continuously outputs a density signal showing the filling density of the shredded tobacco in the tobacco rod TR to the control board 142 when the tobacco rod TR formed in the wrapping device 4 passes through the density detecting device 16.

The control board 142 includes a microprocessor unit (MPU), a random access memory (RAM), a read only memory (ROM), various input/output interfaces and a sampling/recording circuit 144. The sampling/recording circuit 144 receives a density signal from the density detecting device 16 and a cutting signal, respectively. Here, the cutting signal is generated according to the cutting timing of the tobacco rod TR in the cutting device 18. In more detail, since a delay is generated from the point of time when the density detecting device 16 detects the filling density of the shredded tobacco in a cutting portion to be cut in the tobacco rod TR to the point of time when the cutting portion of the tobacco rod TR passes through the cutter of the cutting device 18, the cutting signal is, taking into account of the delay, generated prior to the cutting timing at the cutting device 18. In order to generate such cutting signals, the above-mentioned driving drum 10 is provided with a rotary encoder (not shown), and the rotary encoder outputs pulse signals according to the peripheral speed of the driving drum 10, and the cutting signals are generated based on the pulse signals.

Figure 4:
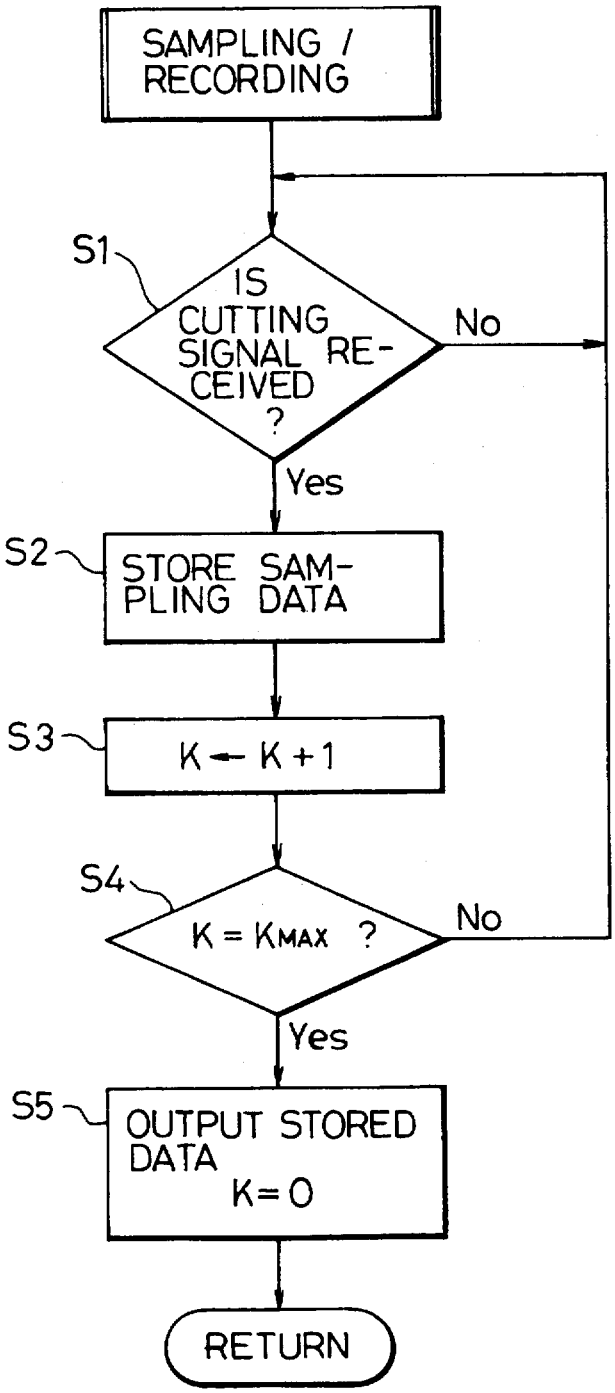
FIG. 4 is a flow chart showing a sampling/recording routine for density signals output from a density detecting device.

The sampling/recording circuit 144 samples the density signals from the density detecting device 16 according to a sampling/recording routine shown in FIG. 4, and records the sampled density data. The sampling/recording routine will be hereinbelow explained.

Sampling/recording routine

First, it is determined whether a cutting signal is received by the circuit 144 or not in Step S1, and if the discrimination result in Step S1 is Yes, sampling processing for the density signal is executed (Step S2). However, if the discrimination result in Step S1 is No, the execution of Step S1 is repeated.

At the sampling processing in Step S2, when a portion of the tobacco rod TR corresponding to one double cigarette DS is divided into equal sections in the number of N (300, for example), the density datum at every $N_X$ section (X is an integer from 1 to N) is sampled, and the sampled data are stored in RAM. Here, the density datum of each section $N_X$ shows a value calculated based on the density signal continuously output from the density detecting device 16 while the $N_X$ section passes through the density detecting device 16, that is, the filling density of the $N_X$ section.

After that, a value K in a counter is incremented by only one (Step S3), and it is discriminated whether the counter value K reaches a maximum value $K_{MAX}$ (500, for example) or not (Step S4). When the discrimination result in Step S4 is No, the program goes back from Step S4 to Step 1, and the execution from Step S1 to S4 is repeated.

On the other hand, if the discrimination result in Step S4 is Yes, the density data stored in RAM is output in the next Step S5, and then, the counter value K is reset to 0, whereby the sampling/recording routine for the $K_{MAX}$ pieces is completed for one double cigarette DS. After that, the sampling/recording routine is repeatedly executed.

The density data output from the sampling/recording circuit 144 is supplied to a setting section 146 of the control board 142. The setting section 146 sets a target cutting position of the tobacco rod TR based on the density data and supplies a target cutting signal corresponding to the target cutting position to a next processing section 148. The processing section 148 calculates a gap between the target cutting signal and the cutting signal, that is, a deviation between the set target cutting position and the actual cutting position of the tobacco rod TR, and supplies a deviation signal showing this deviation to a calculating section 150. The calculating section 150 calculates a target rotation angle position for the pulse motor 128 based on the deviation signal from the operating section 148, and outputs a control signal corresponding to the target rotation angle position toward the pulse motor 128. Thus, the pulse motor 128 is driven according to the control signal, and an actual rotation angle position of the pulse motor 128 is made to accord with the target rotation angle position. As a result, the rotation phases of the pockets 22 of the pair of trimming disks 20 are controlled at the same time.

Figure 5:
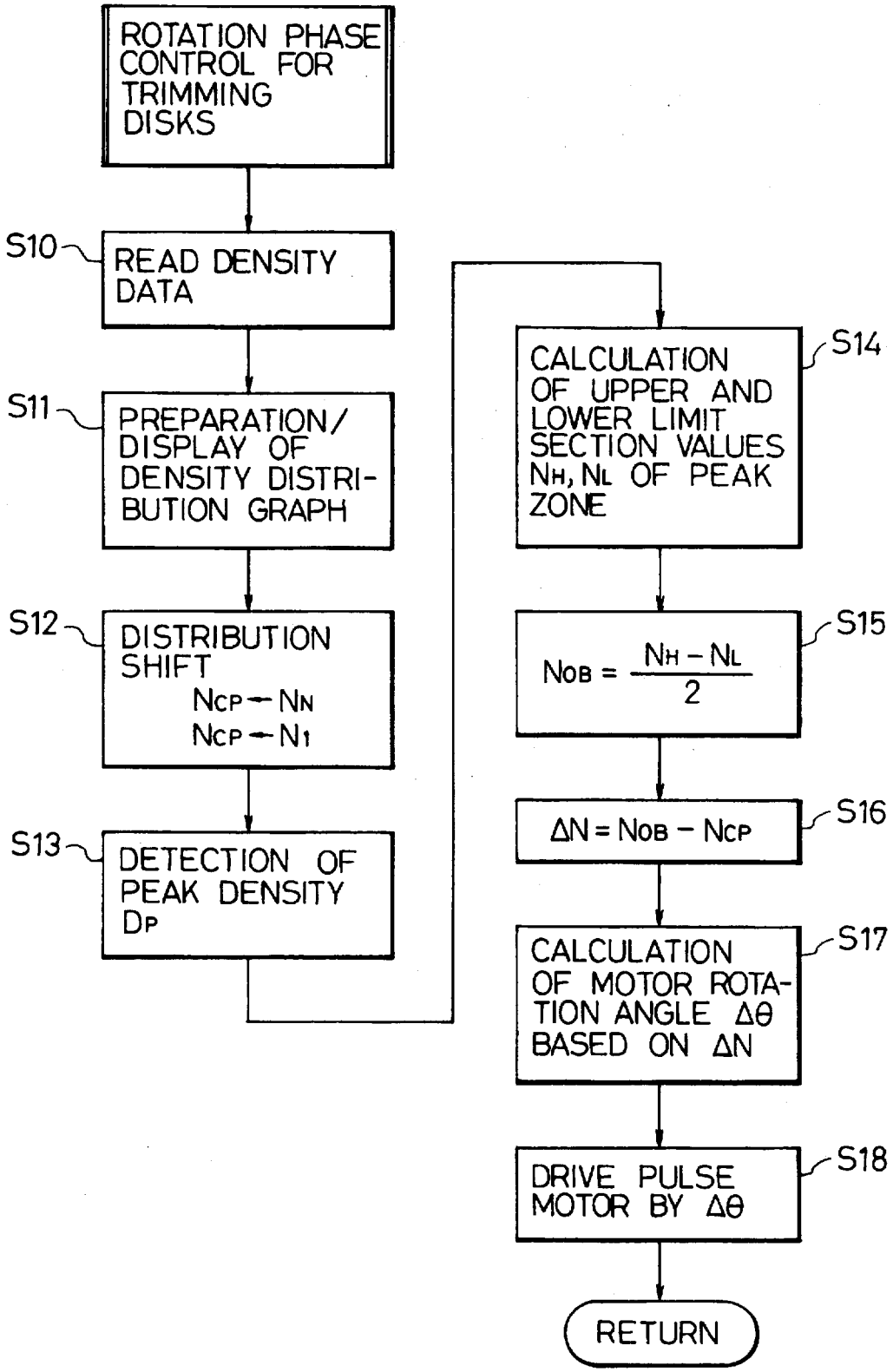
FIG. 5 is a flow chart showing a phase control routine for the trimming disks.

A specific processing from the detecting section 146 to the calculating section 150, that is, a routine for controlling the rotation phases of the trimming disks 20 will be explained hereinbelow in detail referring to the flow chart in FIG. 5.

Control routine for rotation phases of trimming disks

Figure 6:
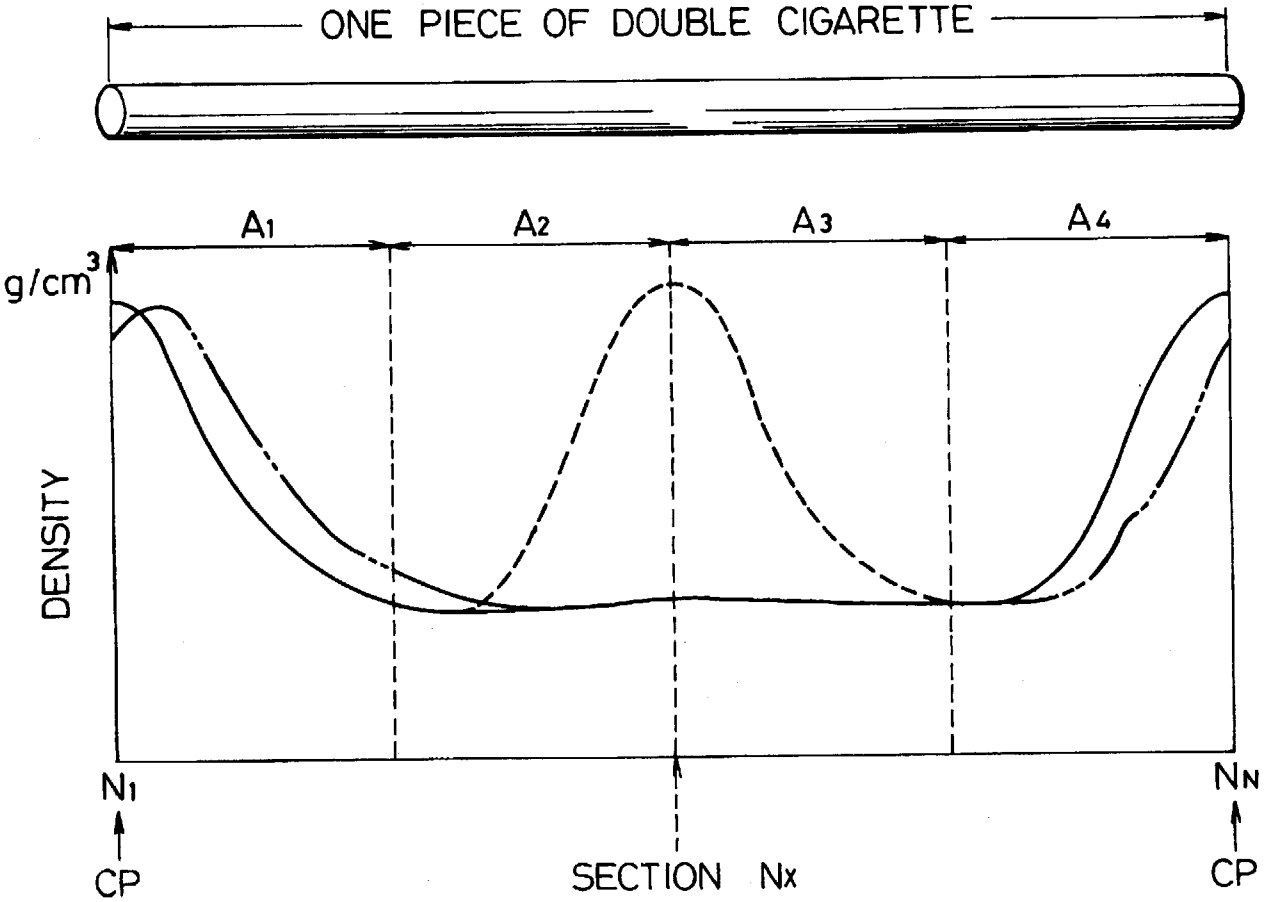
FIG. 6 is a graph showing an average filling density distribution of shredded tobacco in double cigarettes.

First, in Step S10, the density data output from the sampling/recording circuit 144 is read, an average density distribution of the double cigarettes DS as shown by a solid line in FIG. 6 is made from this density data, that is, the density data on $N_{MAX}$ pieces of the double cigarettes DS, and this average density distribution is displayed when necessary (Step S11). In more detail, an average value of the density data is calculated respectively at every $N_X$ sections, and the average density distribution is made by plotting these average values at every $N_X$ sections. In order to display the average density distribution, a CRT 152 is connected to the control board 142 as shown in FIG. 1.

As can be seen from the above explanation, sampling of the density data is started based on the cutting signal, and the tobacco rod TR is actually cut at the sections $N_1$ and $N_N$ located at both ends of the average density distribution in FIG. 6. As shown in FIG. 1, the actual cutting position CP of the tobacco rod TR is also displayed on the CRT 152 with the average density distribution.

Figure 7:
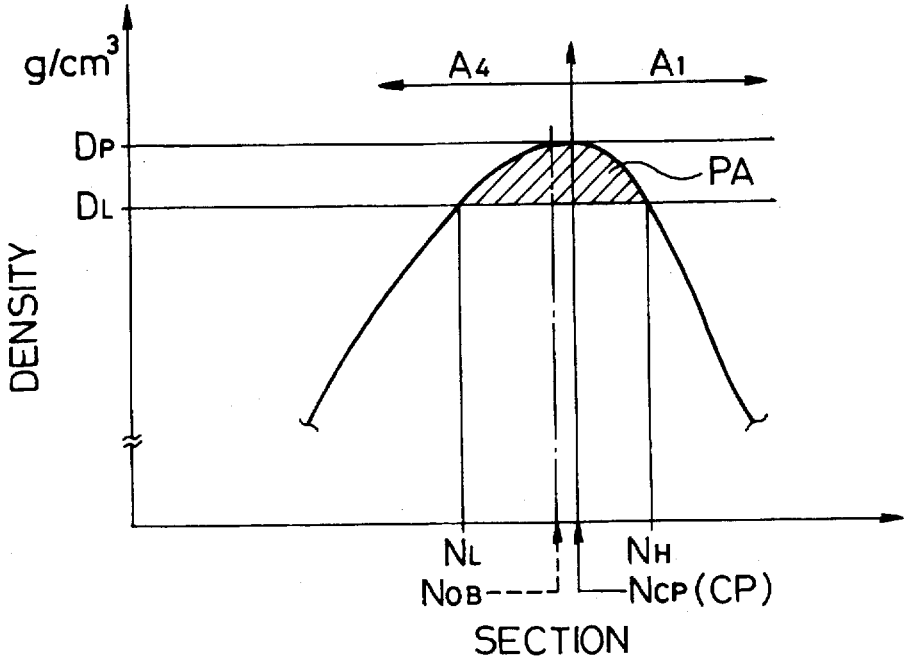
FIG. 7 is a graph showing a result with a part of the average density distribution in FIG. 6 shifted.

At the next Step S12, the average density distribution in FIG. 6 is shifted along the abscissa as shown in FIG. 7. That is, when the density distribution in FIG. 6 is equally divided to zones from $A_1$ to $A_4$, the density distribution is shifted so that the zones $A_1$ and $A_4$ located separately at both ends are continued to each other. As a result, a continuous curve showing the density distribution in FIG. 7 includes the cutting position CP. Specifically, the density distribution in FIG. 7 is obtained by positioning the zones of the sections $N_1$ and $N_N$ located at both side of the cutting position CP as the same section $N_{CP}$ and by rearranging the other sections $N_X$ of the zones $A_1$ and $A_4$ with the section $N_{CP}$ as a reference.

After the density distribution in FIG. 7 is obtained in this way, in next Steps S13 and S14, first, a peak $D_P$ of the density distribution is detected. A density value $D_L$ smaller than the detected peak $D_P$ by a predetermined proportion (0.2%, for example) is calculated, and a peak zone $P_A$ above the density value $D_L$ (a shaded zone in FIG. 7) is obtained. An upper limit section $N_H$ and a lower limit section $N_L$ located at both ends of the peak zone $P_A$ are calculated, respectively.

After that, a target cutting position, that is, a target cutting section $N_{OB}$ is calculated from the upper limit section $N_H$ and the lower limit section $N_L$ based on the following equation (Step S15):

$N_{OB}=(N_H-N_L)/2$

In the next Step S16, a deviation "N between the target cutting section $N_{OB}$ and the reference section $N_{CP}$ or the actual cutting section $C_P$ is calculated by the following equation, and based on this deviation ΔN, a target angle of rotation Δθ of the pulse motor 128 is calculated (Step S17):

$\Delta=N_{OB}-N_{CP}$

At the next Step S18, the pulse motor 128 is driven by the target angle of rotation Δθ. Thus, the helical gear 88 is displaced in its axial direction as mentioned above, and the rotation phases of the pockets 22 of the pair of trimming disks 20 are advanced or delayed, respectively. Therefore, if the actual cutting position CP is dislocated from the target cutting section $N_{OB}$, the dislocation is automatically corrected, and as a result, the cutting device 18 can cut the tobacco rod TR accurately at the target cutting positions.

The target cutting section $N_{OB}$ is set at the center of the above-mentioned peak zone $P_A$ seen in the width direction, and a sufficient width is secured between the target cutting section $N_{OB}$ and the upper limit section $N_H$, and between the target cutting section $N_{OB}$ and the lower limit section $N_L$. Thus, when the tobacco rod TR is cut at the target cutting section and the separate double cigarettes DS are obtained, the filling density of the shredded tobacco in these double cigarettes DS is sufficiently high over the sufficient length from the cut ends. As a result, drop of the shredded tobacco from the cut ends of the tobacco rod TR or the double cigarettes DS during cutting of the tobacco rod TR and subsequent transportation of the double cigarettes DS can be surely prevented, and quality of the double cigarettes is improved.

Figure 8:
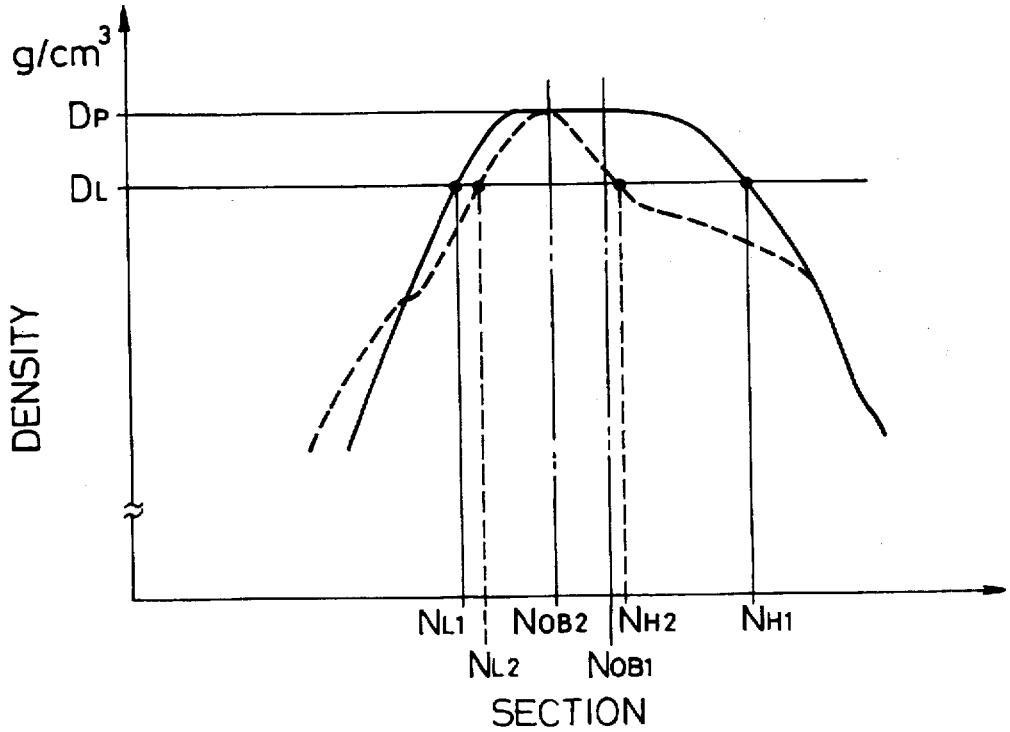
FIG. 8 is a graph showing a part of an average density distribution having a peak zone in the shape different from the peak zone of the density distribution in FIG. 7.

Even if the peak of the density distribution is flat as shown by a solid line in FIG. 8, a target cutting section $N_{OB1}$ is set at the central position in the width direction of the peak zone. Also, even if the peak zone of the density distribution is narrow as shown by a broken line in FIG. 8, a target cutting section $N_{OB2}$ is set at the central position in the width direction of the peak zone. Thus, regardless of the shape of the peak zone of the density distribution, the target cutting section $N_{OB}$ is set at the center of the portion with high shredded-tobacco filling density, and loss of the shredded tobacco from the cut ends of the double cigarettes DS can be surely prevented.

Moreover, in the above-mentioned preferred embodiment, the average density distribution shown in FIG. 6 is displayed on the CRT 152 with its cutting position CP, and when the average density distribution on this CRT 152 is shown by a two dot chain line in FIG. 6, dislocation between the target cutting position and the actual cutting position can be easily recognized.

The manufactured double cigarettes are supplied to a filter attachment for manufacturing filter cigarettes. In this filter attachment, the double cigarette is first cut at the center to obtain a pair of cigarettes. A predetermined space is secured between these cigarettes, and a filter plug is arranged at the space. By wrapping a tip paper piece around the pair of cigarettes with the filter plug between them, the pair of these cigarettes and the filter plug are connected to each other to obtain a double filter cigarette. After that, the double filter cigarette is cut at the center to have separate filter cigarettes.

In relation to the manufacture of filter cigarettes, immediately after the double cigarette is cut into a pair of cigarettes, the filter plug is arranged between these cigarettes. Therefore, the shredded tobacco will not drop from the cut ends of these cigarettes.

The density signal from the density detecting device 16 is sent not only to the control board 142 but also to a control circuit 154 for controlling an average filling amount of the shredded tobacco, as shown in FIG. 1. This control circuit 154 calculates the average filling amount of the shredded tobacco in the predetermined number of the double cigarettes DS based on the density signal and the manufacturing speed of the tobacco rod TR. The control circuit 154 acquires a deviation between the calculated average filling amount and a target filling amount, and based on this deviation, an adjustment signal is output from the control circuit 154 to a level adjusting mechanism 156 for the tobacco band 6. The level adjusting mechanism 156 elevates the tobacco band 6 up and down against the pair of trimming disks 20 based on the adjustment signal.

Figure 9:
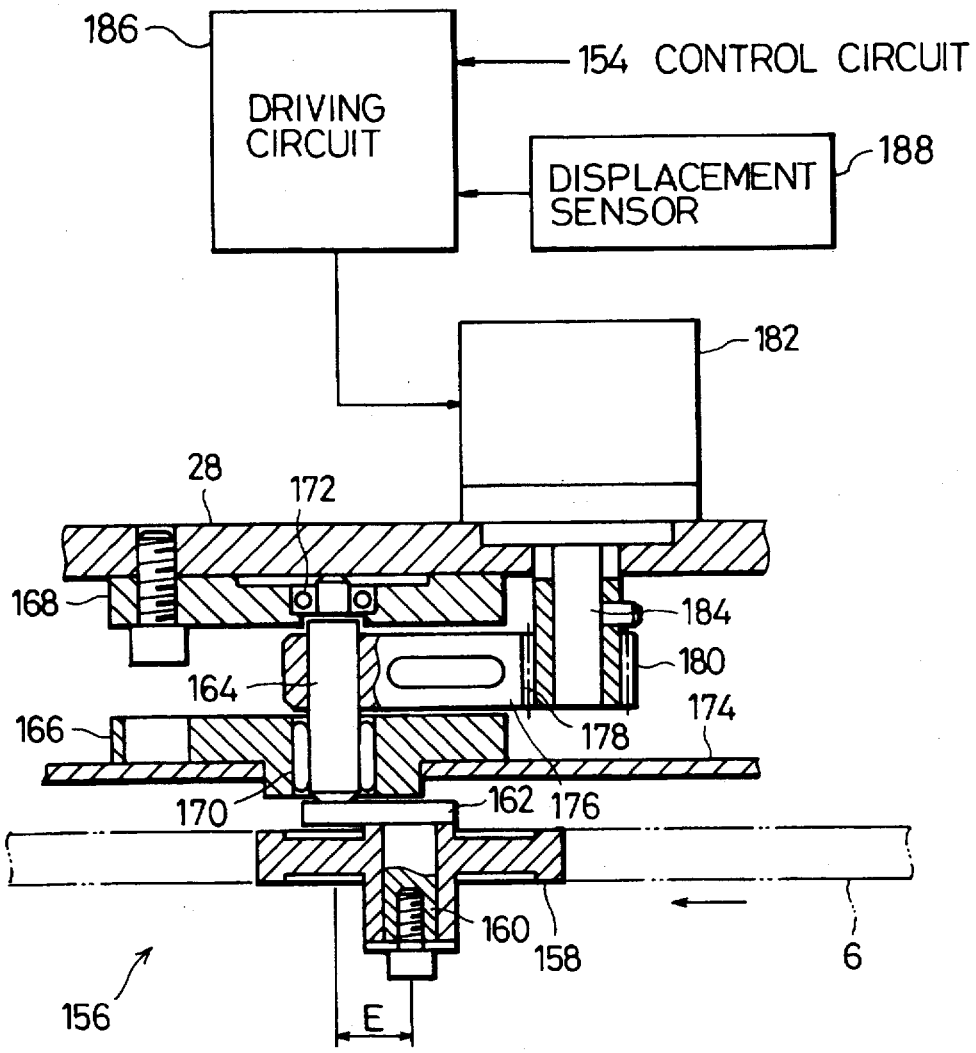
FIG. 9 is a cross sectional view showing a level adjusting mechanism for a tobacco band.
Figure 10:
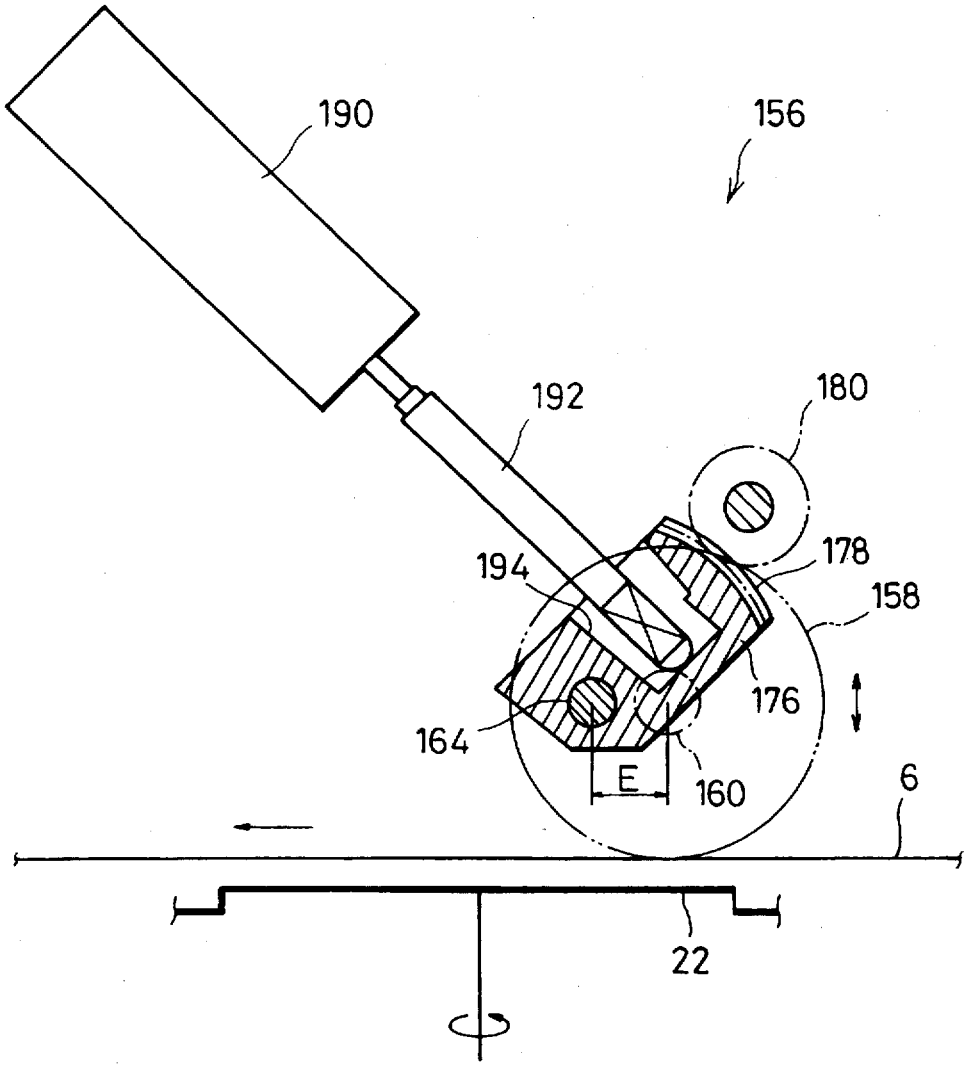
FIG. 10 is a front view schematically showing the level adjusting mechanism in FIG. 9.

Referring to FIGS. 9 and 10, the level adjusting mechanism 156 is shown. The level adjusting mechanism 156 is provided with an adjusting roller 158 arranged inside the endless tobacco band 6, and the adjusting roller 158 is positioned above the pair of trimming disks 20 and rotated in contact with the tobacco band 6. The rotating contact point of the adjusting roller 158 with the tobacco band 6 is on the upstream side from the position where the pair of trimming disks 20 are rotated in contact with each other seen in the running direction of the tobacco band 6 and positioned within the radius of the trimming disk 20. In FIG. 9, the tobacco band 6 is shown by a two dot chain line, while in FIG. 10, the adjusting roller 158 is shown by a two dot chain line.

The adjusting roller 158 is rotatably mounted at a roller shaft 160, and one end of the roller shaft 160 located at the side of the above-mentioned frame 28 protrudes from the adjusting roller 158. On one end of the roller shaft 160, a connecting arm 162 is integrally formed, and the connecting arm 162 extends in the radial direction of the adjusting roller 158. To the distal end of the connecting arm 162, one end of an eccentric pin 164 is linked. The eccentric pin 164 extends in the direction crossing the running direction of the tobacco band 6, and both ends of the eccentric pin 164 are rotatably supported with respect to a pair of bearing plates 166 and 168 by means of bearings 170,172. One bearing plate 168 is fixed to the frame 28, while the other bearing plate 166 is fixed to an outer wall of a suction cover 174. This suction cover 174 covers the tobacco band 6 from above, and its inside space is defined as a suction chamber.

A rotating plate 176 is integrally mounted to the eccentric pin 164, and the rotating plate 176 is arranged between the bearing plates 166 and 168. As can be seen from FIG. 10, the rotating plate 176 has a circular face around the eccentric pin 164, and the circular face is formed as a gear face. That is, the circular part of the rotating plate 176 is formed as a sector gear 178.

The sector gear 178 is engaged with a driving gear 180, and this driving gear 180 is mounted on an output shaft 184 of an electric motor 182. The electric motor 182 is fixed to the frame 28, and the output shaft 184 of the electric motor 180 extends through the frame 28.

The electric motor 180 is electrically connected to a driving circuit 186, and the driving circuit 186 is connected to the above-mentioned control circuit 154. Thus, the driving circuit 186 can receive the adjustment signal output from the control circuit 154. Moreover, a displacement sensor 188 is electrically connected to the driving circuit 186. As shown in FIG. 10, the displacement sensor 188 is provided with a differential transducer 190, and the differential transducer 190 is arranged above the rotating plate 176. The differential transducer 190 has a detection rod 192, and the detection rod 192 extends toward the rotating plate 176. The distal end of the detection rod 192 enters a blind hole 194 of the rotating plate 176 and is pressed to the bottom of the blind hole 194.

According to the above-mentioned level adjusting mechanism, when the adjustment signal is supplied from the control circuit 154 to the driving circuit 186, the driving circuit 186 rotates the output shaft 184 of the electric motor 182 forward or backward according to the adjustment signal. Thus, by engagement between the driving gear 180 and the sector gear 178 of the output shaft 184, the rotating plate 176 is rotated and the eccentric pin 164 is also rotated with this rotation. The eccentric pin 164 is connected to the roller shaft 160 through the connecting arm 162 in the state where it is made eccentric from the roller shaft 160 by a distance "E", and the adjusting roller 158 is rotated around the eccentric pin 164 with rotation of the eccentric pin 164. Thus, the adjusting roller 158 is moved vertically with the tobacco band 6, and as a result, the interval between the tobacco band 6 and the pair of trimming disks 20, that is, the layer thickness of the shredded tobacco layer TL is adjusted.

The detection rod 192 of the displacement sensor 188 is telescopically moved following the rotation of the rotating plate 176, and the distal end of the detection rod 192 is displaced. This displacement is detected by the differential transducer 190, and the differential transducer 190 outputs a displacement signal according to the displacement of the detection rod 192 to the driving circuit 186. The driving circuit 186 compares a target displacement amount of the detection rod 192 obtained based on the supplied adjustment signal and a displacement signal output from the differential transducer 109, that is, an actual displacement amount, and stops driving of the electric motor 182 at the point of time when this actual displacement amount accords with the target displacement amount. Thus, according to the above-mentioned level adjusting mechanism 156, it can be accurately determined whether the adjusting roller 158 is vertically moved by an amount corresponding to the adjustment signal or not, and the adjusting roller 158 can be adjusted with accuracy.

When the tobacco band 6 is to be replaced while operation of the cigarette manufacturing machine is suspended, the above-mentioned vertical cylinder 30 is extended. By this extension, the pair of trimming disks 20 are lowered through the mount plate 26, and the tobacco band 6 can be replaced easily. As the vertical movement of the mount plate 26 is absorbed by the universal joint 122, it is not necessary to separate the power transmission system to the pair of trimming disks 20 while the tobacco band 6 is being replaced.

In case of the above preferred embodiment, in shifting from the density distribution in FIG. 6 to the density distribution in FIG. 7, the sections $N_1$ and $N_N$ are shifted overlapping with the same section $N_{CP}$, but it may be so set that these sections $N_1$ and $N_N$ are set as adjacent sections $N_{CP1}$ and $N_{CP2}$.

In the above preferred embodiment, the filling density of the shredded tobacco is increased only at the cut ends of the manufactured double cigarettes DS. However, in relation to the pair of trimming disks 20, if the number of their pockets 22 is increased, a portion whose shredded-tobacco filling density is increased can be formed at the center of the double cigarette DS as shown by the density distribution of a broken line in FIG. 6. This portion is cut in the filter attachment.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A trimming control device for a cigarette manufacturing machine comprising:

trimming means for trimming a shredded tobacco layer, said trimming means including a rotatable trimming disk, the trimming disk having pockets on the peripheral edge thereof, a thickness of the shredded tobacco layer being adjusted by rotation of the trimming disk when the shredded tobacco layer is continuously fed toward a wrapping device for forming a tobacco rod in said cigarette manufacturing machine so that after the trimming of the shredded tobacco layer, increase portions whose thickness is increased by the pockets are cyclically formed;

detecting means for detecting a filling density of the shredded tobacco in the tobacco rod in a process that the formed tobacco rod is continuously sent out from the wrapping device to a cutting device in said cigarette manufacturing machine and for continuously outputting the detected filling density;

data processing means for acquiring a filling density distribution of the shredded tobacco in a cigarette rod based on the filling density output from said detecting means, the cigarette rod being obtained by cutting the increase portions of the tobacco rod in the cutting device;

determining means for determining a target cutting position of the tobacco rod at a central position of a zone showing the increase portion based on the filling density distribution; and adjusting means for detecting a deviation between the target cutting position and a cut end of the cigarette rod and for adjusting a rotation phase of the pockets of the trimming disk in the direction to eliminate the deviation, said determining means extracts a peak zone including a peak of density from the density distribution and determines a target cutting position at the central position in view of the width direction of the peak zone.

2. The device according to claim 1, wherein said data processing means includes sampling means for equally dividing a piece of the tobacco rod corresponding to one cigarette rod into sections and for sampling the filling density of the shredded tobacco in each section so that the filling density distribution is made from the filling density of the each section.

3. The device according to claim 2, wherein said data processing means includes recording means for collecting at least some of the filling density of the sections of the cigarette rods so that the filling density distribution is made from average filling density of the each sections.

4. The device according to claim 1, wherein said data processing means further includes display means for displaying the filling density distribution which was made.

5. The device according to claim 4, wherein the display means displays an actual cutting position of the tobacco rod in addition to the filling density distribution.

6. The device according to claim 1, wherein said determining means extracts as the peak zone a range above a density value lowered from the peak by a predetermined proportion.

7. The device according to claim 1, wherein said adjusting means includes a gear train for transmitting a torque to the trimming disk, the gear train having a pair of helical gears engaged with each other and moving means for moving one of the helical gears in an axial direction thereof.

8. The device according to claim 7, wherein the moving means includes a slider member which is moved integrally with the helical gear in relation to the axial direction of the helical gear and rotatably supports the helical gear, a feed screw for moving the slider member in the axial direction and a step motor for rotating the feed screw forward and backward.

* * * * *